US011527340B2

(12) United States Patent
Nakamura

(10) Patent No.: US 11,527,340 B2
(45) Date of Patent: Dec. 13, 2022

(54) RFEB-BASED SINTERED MAGNET

(71) Applicant: DAIDO STEEL CO., LTD., Nagoya (JP)

(72) Inventor: Michihide Nakamura, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 684 days.

(21) Appl. No.: 16/450,386

(22) Filed: Jun. 24, 2019

(65) Prior Publication Data

US 2020/0013529 A1 Jan. 9, 2020

(30) Foreign Application Priority Data

Jul. 9, 2018 (JP) ..... JP2018-129932
Jan. 23, 2019 (JP) ..... JP2019-009098

(51) Int. Cl.

| | |
|---|---|
| ***H01F 1/057*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |

(52) U.S. Cl.

CPC ..... *H01F 1/0577* (2013.01); *C22C 38/005* (2013.01); *C22C 38/06* (2013.01); *C22C 38/10* (2013.01); *C22C 38/14* (2013.01); *C22C 38/16* (2013.01); *C22C 2202/02* (2013.01)

(58) Field of Classification Search

CPC ..... H01F 1/0577; C22C 38/005; C22C 38/06; C22C 38/10; C22C 38/14; C22C 38/16; C22C 2202/02

USPC ..... 335/302

See application file for complete search history.

(56) References Cited

U.S. PATENT DOCUMENTS

| | | | |
|---|---|---|---|
| 2004/0189426 | A1 | 9/2004 | Hidaka et al. |
| 2006/0137767 | A1 | 6/2006 | Yamamoto et al. |
| 2007/0245851 | A1 | 10/2007 | Sagawa et al. |
| 2009/0020193 | A1 | 1/2009 | Ohta et al. |

(Continued)

FOREIGN PATENT DOCUMENTS

| | | | |
|---|---|---|---|
| CN | 101911227 | A | 12/2010 |
| CN | 103456452 | A | 12/2013 |

(Continued)

OTHER PUBLICATIONS

Chinese Office Action, dated Jul. 31, 2020, in Chinese Application No. 201910610471.7 and English Translation thereof.

(Continued)

*Primary Examiner* — Humera N. Sheikh
*Assistant Examiner* — Katherine A Christy
(74) *Attorney, Agent, or Firm* — McGinn I.P. Law Group, PLLC.

(57) ABSTRACT

The present invention relates to an RFeB-based sintered magnet having a composition including: 24-31% by mass of at least one element selected from the group consisting of Nd, Pr, La and Ce; 0.1-6.5% by mass of at least one element selected from the group consisting of Dy and Tb; 0.8-1.4% by mass of B; 0.03-0.2% by mass of at least one element selected from the group consisting of Zr, Ti, Hf and Nb; 0.8-5.5% by mass of Co; 0.1-1.0% by mass of Cu; and 0.1-1.0% by mass of Al, with a remainder being Fe and unavoidable impurities, in which the composition has a total content of Cu and Al being higher than 0.5% by mass.

7 Claims, 7 Drawing Sheets

(56) References Cited

U.S. PATENT DOCUMENTS

| | | | |
|---|---|---|---|
| 2010/0282371 | A1 | 11/2010 | Sagawa et al. |
| 2013/0169394 | A1 | 7/2013 | Sagawa et al. |
| 2013/0343946 | A1 | 12/2013 | Sagawa et al. |
| 2014/0062631 | A1 | 3/2014 | Sagawa et al. |
| 2014/0062632 | A1 | 3/2014 | Sagawa et al. |
| 2014/0118098 | A1 | 5/2014 | Sagawa et al. |
| 2014/0327503 | A1 | 11/2014 | Sagawa et al. |
| 2016/0163435 | A1 | 6/2016 | Miwa et al. |
| 2016/0293307 | A1 | 10/2016 | Hirota et al. |
| 2016/0300650 | A1 | 10/2016 | Sagawa et al. |
| 2018/0182518 | A1 | 6/2018 | Satoh et al. |

FOREIGN PATENT DOCUMENTS

| | | | |
|---|---|---|---|
| CN | 106024253 | A | 10/2016 |
| CN | 106448984 | A | 2/2017 |
| CN | 107710351 | A | 2/2018 |
| EP | 3 425 643 | A1 | 1/2019 |
| JP | 2004-296848 | A | 10/2004 |
| JP | 2006-210376 | A | 8/2006 |
| JP | 2006-210893 | A | 8/2006 |
| JP | 2010-114200 | A | 5/2010 |
| WO | WO 2006/004014 | A1 | 1/2006 |
| WO | WO 2006/112403 | A1 | 10/2006 |
| WO | WO 2015/020180 | A1 | 2/2015 |

OTHER PUBLICATIONS

Extended European Search Report dated Dec. 5, 2019 for European Patent Application No. 19184665.8-1212.

Japanese Office Action dated Oct. 25, 2022, in corresponding Japanese Patent Application No. 2019-009098, with an English translation thereof.

RFEB-BASED SINTERED MAGNET

FIELD OF THE INVENTION

The present invention relates to an RFeB-based sintered magnet including rare earth elements (hereinafter referred to as "R"), Fe (iron), and B (boron) as main constituent elements.

BACKGROUND OF THE INVENTION

An RFeB-based sintered magnet was found by Sagawa et al. in 1982, and has an advantage that many magnetic properties including remanence are far higher than those of conventional permanent magnets. Accordingly, the RFeB-based sintered magnet is used in various products such as various motors including automotive motors for hybrid cars and electric cars and motors for industrial machines, speakers, headphones, and permanent magnet type magnetic resonance diagnostic devices.

Coercivity is one of indexes to the magnetic properties of a magnet. Coercivity is expressed in terms of the intensity of a magnetic field of a magnet at which a magnetization thereof becomes zero when a magnetic field (opposing magnetic field) having a direction opposite to the direction of the magnetization is applied to the magnet. The larger the value of coercivity, the higher the resistance to opposing magnetic fields. Higher coercivities are required for magnets to be used especially in external magnetic fields which fluctuate in direction or intensity, such as, for example, the rotors of various motors.

One of methods for heightening the coercivity of an RFeB-based sintered magnet is to reduce the grain size of the individual crystal grains constituting the RFeB-based sintered magnet. This method renders the individual crystal grains less apt to have oppositely magnetized portions formed therein, in which the magnetization has been inverted along the direction of the opposing magnetic field, thereby attaining an increase in coercivity. For producing an RFeB-based sintered magnet in which the individual crystal grains have a reduced grain size, use is made of a method in which an alloy powder having a reduced particle size is used as a raw material for the RFeB-based sintered magnet.

However, even when an alloy powder having a reduced particle size is used as a raw material and sintered, there are cases where a phenomenon called "abnormal grain growth" occurs in which some of the crystal grains grow abnormally to increase the particle size, resulting in a decrease in coercivity. Patent Documents 1 and 2 each describe an RFeB-based sintered magnet, for which Zr (zirconium) is incorporated into a raw-material alloy. The incorporation of Zr prevents crystal grain growth during sintering to inhibit abnormal grain growth. The content of Zr in the raw-material alloy is 0.03-0.25% by mass in Patent Document 1 and is 0.02-1.5% by mass in Patent Document 2. Patent Document 2 indicates that in cases when Nb (niobium) and/or Hf (hafnium) is incorporated in place of or together with the Zr, the same effect is produced in the RFeB-based sintered magnet.

Patent Documents 1 and 2 each indicate that by incorporating Al and/or Cu together with the Zr, etc., the RFeB-based sintered magnet can be made to have a higher coercivity, higher corrosion resistance, and improved temperature characteristics. The total content of Al and Cu is 0.02-0.5% by mass in Patent Document 1 and is 0.02-0.6% by mass in Patent Document 2. However, neither of Patent Documents 1 and 2 mentions any content range for Al alone or Cu alone, although specific numerical values are shown in Examples (Patent Document 1 shows to incorporate 0.2% by mass of Al and 0.05% by mass of Cu or to incorporate 0.25% by mass of Al and 0.07% by mass of Cu, while Patent Document 2 shows to incorporate 0.054% by mass of Al and 0.1% by mass of Cu).

Furthermore, Patent Document 2 indicates that by adding Cu and Co in combination, the range of annealing temperatures capable of giving a high coercivity is widened. The annealing in Patent Document 2 is a treatment in which, after a sintering step, the sintered object is heated at a temperature which is within a given temperature range (in Patent Document 2, an annealing temperature range of 500-800° C.) and is lower than the temperature used for the sintering (in Patent Document 2, 1,000-1,100° C.). The widened annealing temperature range results in an enlarged permissible range of temperature fluctuations in the annealing and a larger number of RFeB-based sintered magnets can be simultaneously annealed, thereby improving the production efficiency. Patent Document 2 states that the content of Co is 0.5-5% by mass. However, as stated above, Patent Document 2 contains no mention of any content range for Cu, although a specific numerical value is shown in the Examples and the total content of Cu and Al is merely shown.

Patent Document 1: JP-A-2004-296848
Patent Document 2: JP-A-2006-210376
Patent Document 3: WO 2006/004014

SUMMARY OF THE INVENTION

Magnets for use in an external magnetic field which fluctuates in direction and intensity are required to have not only a high coercivity but also an increased squareness ratio. Squareness ratio is expressed by a ratio between the opposing magnetic field $H_k$ at the time when the magnetization in the second quadrant (demagnetization curve) of a magnetization curve becomes 90% of the remanence $B_r$ and the coercivity (opposing magnetic field at the time when magnetization becomes 0) $H_{cJ}$, i.e., $H_k/H_{cJ}$. The higher the squareness ratio, the smaller the fluctuations in magnetization with fluctuating magnetic field. Higher squareness ratios mean that the magnets have stable properties in fluctuating magnetic fields. The RFeB-based sintered magnets described in Patent Documents 1 and 2 cannot have a sufficiently high value of squareness ratio.

An annealing temperature range needs to be set so that not only coercivity but also squareness ratio come to have high values, and needs to be wider.

A problem to be solved by the present invention is to provide an RFeB-based sintered magnet which has a high squareness ratio and for which an annealing temperature range capable of giving high values of coercivity and squareness ratio is wide.

In order to solve the above-described problem, an RFeB-based sintered magnet according to the present invention including:

24-31% by mass of at least one element selected from the group consisting of Nd, Pr, La and Ce (hereinafter referred to as "$R^L$");

0.1-6.5% by mass of at least one element selected from the group consisting of Dy and Tb (hereinafter referred to as "$R^H$");

0.8-1.4% by mass of B;

0.03-0.2% by mass of at least one element selected from the group consisting of Zr, Ti (titanium), Hf and Nb;

0.8-5.5% by mass of Co;

0.1-1.0% by mass of Cu; and 0.1-1.0% by mass of Al, with a remainder being Fe and unavoidable impurities, in which the composition has a total content of Cu and Al being higher than 0.5% by mass.

The content of $R^L$ is given as a value obtained by rounding off to the nearest whole number, and the contents of the other elements are given as values obtained by rounding off to the nearest tenth.

In the RFeB-based sintered magnet according to the present invention, the content of Cu and the content of Al are each 0.1% by mass or higher and the total content of Cu and Al is higher than 0.5% by mass. Furthermore, Co is contained therein in an amount of 0.8% by mass or larger. As a result, the RFeB-based sintered magnet has a heightened squareness ratio, and the range of annealing temperatures capable of giving high values of coercivity and squareness ratio is widened. This is thought to be because due to such contents of Co, Cu, and Al, grain boundaries containing Co, Cu, and Al are formed in the RFeB-based sintered magnet and the grain boundaries have the effect of blocking magnetic interaction among the crystal grains to thereby improve both the coercivity and the squareness ratio. In cases when an annealing conducted at a certain temperature gives higher values of coercivity and squareness ratio than before, higher values of coercivity and squareness ratio are obtained also through an annealing performed at temperatures around that temperature and, as a result, the range of annealing temperatures capable of giving high values of coercivity and squareness ratio is widened.

The effect of blocking magnetic interaction among crystal grains is produced mainly by the Co and Cu. However, the Co and the Cu are prone to separate into respective phases at the grain boundaries and, hence, the Co and Cu by themselves cannot produce a sufficient effect. It is thought that the addition of Al besides the Co and Cu inhibits the phase separation between the Co and Cu, making it possible to sufficiently block magnetic interaction among the crystal grains. As stated above, in Patent Document 2, Al was added in a single amount, which was as small as 0.054% by mass (smaller than the lower limit of 0.1% by mass in the present invention), and Co and Cu are mentioned as the only elements having the effect of widening the annealing temperature range.

However, in case where the content of Al is too high, some of the Fe in the main phase of the RFeB-based sintered magnet is replaced by Al even when a grain boundary diffusion treatment is used, resulting in a decrease in remanence. Consequently, the content of Al in the RFeB-based sintered magnet is 1.0% by mass or less. Meanwhile, in case where the content of Cu is too high, not only the RFeB-based sintered magnet has a reduced remanence but also Cu is excessively present at the grain boundaries, resulting in a decrease in squareness ratio. Consequently, the content of Cu in the RFeB-based sintered magnet is 1.0% by mass or less.

On the other hand, Co may be replaced, to some degree, with some of the Fe within the crystal grains because Co itself has magnetism. Because of this, the content of Co need not be higher at the grain boundaries than in the crystal grains. The content of Co is in the range of 0.8-5.5% by mass so that Co is present at the grain boundaries just in an amount necessary for producing the effect and that replacement of some of the Fe by Co is not problematic. A preferred range of the content of Co, within that range, is from 0.8-3.0% by mass, from the standpoint of inhibiting the coercivity from decreasing. The content of Co is preferably in the range of 1.4-2.5% by mass because this results in an even wider annealing temperature range.

Since Cu and Al are nonmagnetic, these elements, when present in the crystal grains, are causative of a decrease in magnetization. It is hence desirable, in the RFeB-based sintered magnet according to the present invention, that the contents of Cu and Al are higher at the grain boundaries than in the crystal grains. Such an RFeB-based sintered magnet can be obtained by using a treatment including: preparing an RFeB-based sintered object which contains neither Cu nor Al or which contains Cu and/or Al in a smaller amount than in the RFeB-based sintered magnet to be finally obtained; adhering an adhesion material containing both Cu and Al to a surface of the sintered object; and then heating the sintered object to diffuse the Cu and Al from the surface to the inside of the sintered object mainly via the grain boundaries. This treatment is called a grain boundary diffusion treatment. The RFeB-based sintered magnet produced through such a grain boundary diffusion treatment has a distribution in which the content of Cu and the content of Al gradually decrease from the surface of the RFeB-based sintered magnet toward an inner part thereof.

The RFeB-based sintered magnet according to the present invention desirably contains an $R_3$(Co,Fe) phase at the grain boundaries thereof. The $R_3$(Co,Fe) phase, in the case where there are no lattice defects, is configured of atoms of rare earth element R and atoms of both Co and Fe in a ratio of 3:1. The $R_3$(Co,Fe) phase is paramagnetic at room temperature. The presence of the paramagnetic $R_3$(Co,Fe) phase at the grain boundaries more facilitates the blocking of the magnetic interaction among grain boundaries than the presence of elemental Co and Fe, which are ferromagnetic, at the grain boundaries, and this not only improves the coercivity and squareness ratio but also widens the annealing temperature range capable of giving high values of coercivity and squareness ratio. An $R_3$(Co,Fe) phase is yielded at grain boundaries during sintering in producing the RFeB-based sintered magnet according to the present invention, and the melting point of the $R_3$(Co,Fe) phase is lowered by the presence of Cu at the grain boundaries to diffuse the $R_3$(Co, Fe) phase throughout the whole grain boundaries. This also contributes to improvements in coercivity and squareness ratio and to an increase in the width of the annealing temperature range capable of giving high values of coercivity and squareness ratio.

Since the RFeB-based sintered magnet according to the present invention contains at least one element selected from the group consisting of Zr, Ti, Hf and Nb, this sintered magnet is prevented from having a reduced coercivity due to abnormal grain growth. Patent Document 2 mentions at least one element selected from the group consisting of Zr, Hf and Nb as elements for preventing abnormal grain growth. In the present invention, however, Ti may be used in place of or together with these elements. The content of the at least one element selected from the group consisting of Zr, Ti, Hf and Nb is in the range of 0.03-0.2% by mass so that these elements are present in the RFeB-based sintered magnet just in an amount necessary for producing that effect and that these elements do not lower the remanence of the RFeB-based sintered magnet.

The inclusion of $R^H$ in the RFeB-based sintered magnet according to the present invention can also serve to heighten the coercivity. However, although $R^H$ heightens the coercivity of RFeB-based sintered magnets, it is known that the presence thereof in the crystal grains results in a decrease in remanence. It is also known that $R^H$ has the effect of heightening the coercivity so long as the $R^H$ is present near the surfaces of the crystal grains. Consequently, in the RFeB-based sintered magnet according to the present invention, the content of $R^H$ is in the range of 0.1-6.5% by mass and it is desirable that the content thereof is higher in the surface of each crystal grain than in the center of the crystal grain. In this respect, such an RFeB-based sintered magnet may be produced by performing a grain boundary diffusion treatment which includes: preparing an RFeB-based sintered object which contains no $R^H$ or which has an $R^H$ content lower than that of the RFeB-based sintered magnet according to the present invention; adhering an adhesion material containing $R^H$ to a surface of the sintered object; and then heating the sintered object to diffuse the $R^H$ from the surface to the vicinity of the surfaces of the crystal grains of the sintered object via the grain boundaries thereof. In the case of an RFeB-based sintered magnet into which $R^H$ has been introduced by the grain boundary diffusion treatment, this RFeB-based sintered magnet as a whole has a distribution in which the content of $R^H$ gradually decreases from the surface of the RFeB-based sintered magnet toward the inner part thereof, like the contents of Al and Cu.

It is preferable that the RFeB-based sintered magnet according to the present invention further contains Ga (gallium) in an amount of 0.05-1.0% by mass. By incorporating Ga in combination with Co, the coercivity can be heightened.

In general, in cases when the content of rare earth elements is higher, a rare-earth-rich phase which has a high rare-earth-element content and a low melting point is formed more at the grain boundaries of the RFeB-based sintered magnet than in the main phase thereof. During a grain boundary diffusion treatment, the rare-earth-rich phase melts to render the $R^H$ more apt to diffuse throughout the whole grain boundaries of the RFeB-based sintered magnet. As a result, the coercivity and the squareness ratio are heightened. Meanwhile, since rare earth elements are expensive, an increase in the content thereof results in an increased cost. The RFeB-based sintered magnet according to the present invention has a coercivity of 20 kOe or higher and a squareness ratio of 90% or higher even in the case where the total content of all the rare earth elements is 32% by mass or less, which is relatively low. It is hence possible to attain a high coercivity and a high squareness ratio at reduced cost.

According to the present invention, it is possible to obtain an RFeB-based sintered magnet which has a high squareness ratio and for which the range of annealing temperatures capable of giving high values of coercivity and squareness ratio is wide.

DETAILED DESCRIPTION OF THE INVENTION

Figure 1:
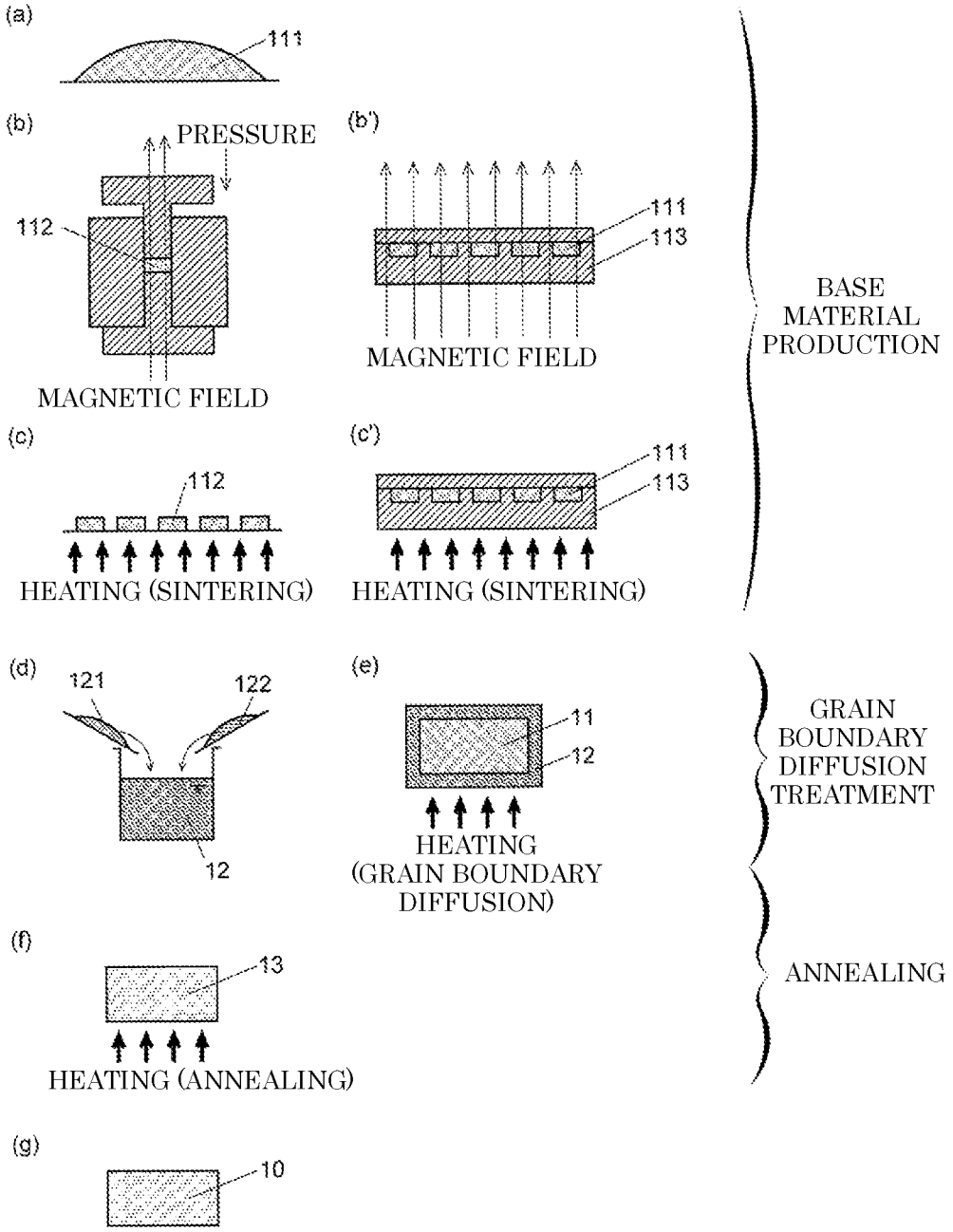
FIG. 1 is diagrammatic views which illustrate one example of processes for producing an RFeB-based sintered magnet according to the present invention.

Embodiments of the RFeB-based sintered magnet according to the present invention are explained using FIG. 1 to FIG. 9.

(1) Composition

The RFeB-based sintered magnet of the present embodiment includes 24-31% by mass of $R^L$, 0.1-6.5% by mass of $R^H$, 0.8-1.4% by mass of B, 0.03-0.2% by mass of at least one element selected from the group consisting of Zr, Ti, Hf and Nb, 0.8-5.5% by mass of Co, 0.1-1.0% by mass of Cu, and 0.1-1.0% by mass of Al, with a remainder being Fe and unavoidable impurities. However, the total content of Cu and Al needs to be higher than 0.5% by mass. The RFeB-based sintered magnet of the present embodiment may contain 0.05-1.0% by mass of Ga besides those elements.

In producing the RFeB-based sintered magnet of the present invention, it is preferable that Cu and Al are introduced into the RFeB-based sintered magnet by the grain boundary diffusion treatment which will be described under (2), in order that the contents thereof are higher at the grain boundaries than in the crystal grains. The RFeB-based sintered magnet thus produced has a distribution in which the content of Cu and the content of Al are highest in at least some of the surface. It is also preferred to introduce $R^H$ by the grain boundary diffusion treatment into the RFeB-based sintered magnet, like Cu and Al. However, at least one of Cu, Al, and $R^H$ may be introduced into the RFeB-based sintered magnet by a method other than the grain boundary diffusion treatment (in this case, all of these elements may be thus introduced). For example, at least one of Cu, Al, and $R^H$ may be added beforehand to a raw material for a sintered object.

The RFeB-based sintered magnet of the present embodiment may further contain, as unavoidable impurities, up to 0.1% by mass of Cr (chromium), up to 0.1% by mass of Mn (manganese), up to 0.1% by mass of Ni, up to 3,500 ppm of 0 (oxygen), up to 2,000 ppm of N (nitrogen), and up to 2,000 ppm of C (carbon). It is desirable that the content of 0 is 1,500 ppm or less, the content of N is 1,000 ppm or less, and the content of C is 1,000 ppm or less.

(2) Production Process

An example of processes for producing an RFeB-based sintered magnet according to one embodiment is explained by reference to FIG. 1. First, a base material 11 including an RFeB-based sintered object is produced by the following method. A raw-material alloy including elements in amounts corresponding to the composition of the base material 11 to be produced is prepared. In the case where the grain boundary diffusion treatment which will be described later is to be performed, the raw material to be used is either one which does not contain at least one of Cu, Al, and $R^H$ (or which may contain none of these) and contains the other elements in amounts within the respective ranges shown above or one which contains at least one of Cu, Al, and $R^H$ (or may contain all of Cu, Al, and $R^H$) in respective amounts smaller than in the RFeB-based sintered magnet to be finally obtained. Meanwhile, in the case where the grain boundary diffusion treatment is not performed, use is made of a raw material which includes Cu, Al, and $R^H$, and the other elements that the RFeB-based sintered magnet to be finally obtained is to contain, in respective amounts within the ranges shown above.

The base material 11 can be obtained by pulverizing the raw-material alloy to produce a raw-material powder 111 (see (a) in FIG. 1), compression-molding the raw-material powder 111 while orienting the raw-material powder 111 in a magnetic field, thereby producing a compression-molded object 112 (see (b) in FIG. 1), and heating the compression-molded object 112 to sinter the raw-material powder 111 (pressing method) (see (c) in FIG. 1). Alternatively, the base material 11 can be obtained by producing a raw-material powder 111 in the same manner as described above, filling the raw-material powder 111 into a mold 113 having a shape corresponding to the base material 11 to be produced (see (b') in FIG. 1), and orienting the raw-material powder in a magnetic field and heating and sintering the oriented raw-material powder without performing compression molding (PLP (press-less process) method; see Patent Document 3) (see (c') in FIG. 1). With respect to the particle size of the raw-material powder 111, the heating temperature for sintering, etc., the conditions used in producing conventional RFeB-based sintered magnets can be used as such. For example, from the standpoint of producing an RFeB-based sintered magnet in which the crystal grains have a reduced grain size, it is desirable that the particle size of the raw-material powder is smaller. The raw-material powder is desirably regulated so as to have a median particle diameter (D50), as determined, for example, by a laser method, of 3 μm or less (see Patent Document 3). The temperature during the sintering can be, for example, in the range of 1,000-1,100° C. in the pressing method (see Patent Documents 1 and 2) or 900-1,050° C. in the PLP method (see Patent Document 3).

A treatment by the grain boundary diffusion method is given to the produced base material 11 in the following manner. First, an adhesion material 12 containing one or more elements, among $R^H$, Cu, and Al, that are to be introduced by the grain boundary diffusion treatment is produced. Preferred for use as raw materials for the adhesion material 12 are, for example, an alloy of $R^H$, Cu, and Al and a silicone grease 122. Specifically, the alloy is pulverized to produce a powder 121 for the grain boundary diffusion treatment, and a silicone grease 122 is added to and mixed with the powder 121 for the grain boundary diffusion treatment, thereby producing a pasty adhesion material 12 (see (d) in FIG. 1). In place of the alloy of $R^H$, Cu, and Al, use may be made of the three elemental metals each in a powder form or use may be made of an alloy of two of the three metals and a powder of the remaining one elemental metal. The $R^H$ may be only one of Dy and Tb or may be both. In the case where two or less elements among $R^H$, Cu, and Al is to be introduced by the grain boundary diffusion treatment, use is made of an alloy including only the element(s) to be introduced.

Subsequently, the adhesion material 12 is applied to surfaces of the base material 11, and the coated base material 11 is heated to a given temperature (see (e) in FIG. 1). Thus, the elements to be subjected to grain boundary diffusion which are contained in the adhesion material 12 are diffused into the grain boundaries of the base material. The temperature in this heating can be, for example, in the range of 700-1,000° C.

By thus performing the grain boundary diffusion treatment, an unannealed RFeB-based sintered magnet 13 is obtained. Meanwhile, in the case of not performing the grain boundary diffusion treatment, the obtained base material 11 is used, as such, as an unannealed RFeB-based sintered magnet 13. Next, the unannealed RFeB-based sintered magnet 13 obtained is heated at a temperature lower than that used in the sintering, thereby performing an annealing (see (f) in FIG. 1). The temperature for the annealing is, for example, in the range of 460-560° C. Although performing the annealing once suffices, the treatment may be performed two or more times. By the procedure described above, an RFeB-based sintered magnet 10 according to this embodiment is obtained (see (g) in FIG. 1).

(3) Examples of RFeB-based Sintered Magnets According to This Embodiment

Examples are shown below, in which RFeB-based sintered magnets according to this embodiment were produced.

(3-1) Examples 1 and 2

Alloys 1 and 2 respectively having the compositions (measured values) shown in Table 1 were used as raw materials to produce base materials by the PLP method. Subsequently, each base material was molded into a plate shape having a thickness of 4.8 mm. An adhesion material obtained by adding a silicone grease to a powder for grain boundary diffusion treatment obtained by pulverizing a TbCuAl alloy including 75.3% by mass of Tb, 18.8% by mass of Cu, and 5.9% by mass of Al was thereafter applied to the front and back surfaces of the plate-shaped base material, and the coated base material was heated at 900° C. for 15 hours, thereby performing a grain boundary diffusion treatment to produce an unannealed RFeB-based sintered magnet. The unannealed RFeB-based sintered magnets thus obtained were each heated at temperatures in the range of 460-560° C. to perform an annealing. Thus, RFeB-based sintered magnets of Example 1 and RFeB-based sintered magnets of Example 2 were produced respectively from alloy 1 and alloy 2. In each of Examples 1 and 2, a plurality of base materials and unannealed RFeB-based sintered magnets were produced and, in the annealing, the plurality of unannealed RFeB-based sintered magnets were heated respectively at different temperatures (temperatures differing at interval of 20° C. in the range of 460-560° C.). In each of Examples 1 and 2, one of the obtained RFeB-based sintered magnets was analyzed for composition, and the measured values are shown in Table 2.

TABLE 1

| Compositions of alloys as raw materials for base materials (unit: mass %) | | | | | | | | | | |
|---|---|---|---|---|---|---|---|---|---|---|
| | Nd | Pr | Dy | Tb | Co | B | Al | Cu | Zr | Fe |
| Alloy 1 | 26.5 | 4.70 | 0 | 0 | 1.41 | 0.97 | 0.23 | 0.21 | 0.10 | remainder |
| | $R^L$: 31.20 | | $R^H$: 0 | | | | | | | |
| Alloy 2 | 26.3 | 4.52 | 0 | 0 | 2.55 | 0.98 | 0.17 | 0.12 | 0.10 | remainder |
| | $R^L$: 30.82 | | $R^H$: 0 | | | | | | | |

TABLE 2

| Compositions of RFeB-based sintered magnets obtained (unit: mass %) | | | | | | | | | | |
|---|---|---|---|---|---|---|---|---|---|---|
| | Nd | Pr | Dy | Tb | Co | B | Al | Cu | Zr | Fe |
| Example 1 | 25.8 | 4.51 | 0.03 | 0.48 | 1.36 | 0.96 | 0.30 | 0.39 | 0.10 | remainder |
| | $R^L$: 30.31 | | $R^H$: 0.51 | | | | | | | |
| Example 2 | 25.7 | 4.38 | 0.03 | 0.49 | 2.45 | 0.97 | 0.23 | 0.32 | 0.10 | remainder |
| | $R^L$: 30.08 | | $R^H$: 0.52 | | | | | | | |

In each of Examples 1 and 2, the contents of the elements in each obtained RFeB-based sintered magnet were within the ranges according to the present invention. The RFeB-based sintered magnets of Example 1 had higher contents of Al and Cu than the RFeB-based sintered magnets of Example 2. Meanwhile, the RFeB-based sintered magnets of Example 2 had a higher content of Co than the RFeB-based sintered magnets of Example 1. Although the RFeB-based sintered magnets of Examples 1 and 2 contained 0.03% by mass Dy, which had not been contained in the raw materials for the base materials, this is thought to be because the TbCuAl alloy had contained a slight amount of Dy as an impurity.

Figure 2:
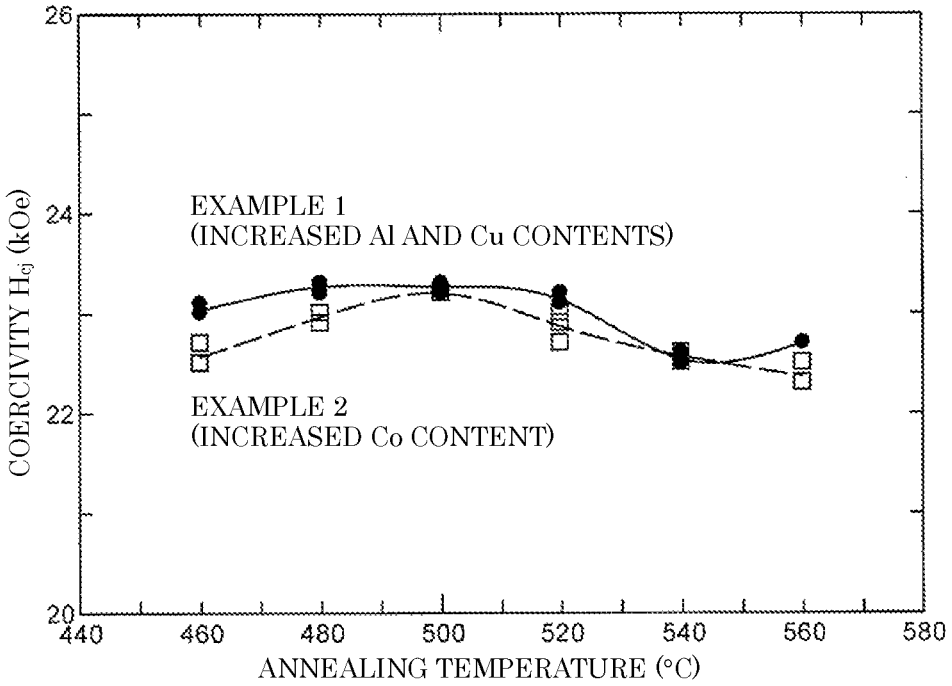
FIG. 2 is a graph which shows relationships between annealing temperature in producing RFeB-based sintered magnets according to the present invention in Examples 1 and 2 and measured values of coercivity.
Figure 3:
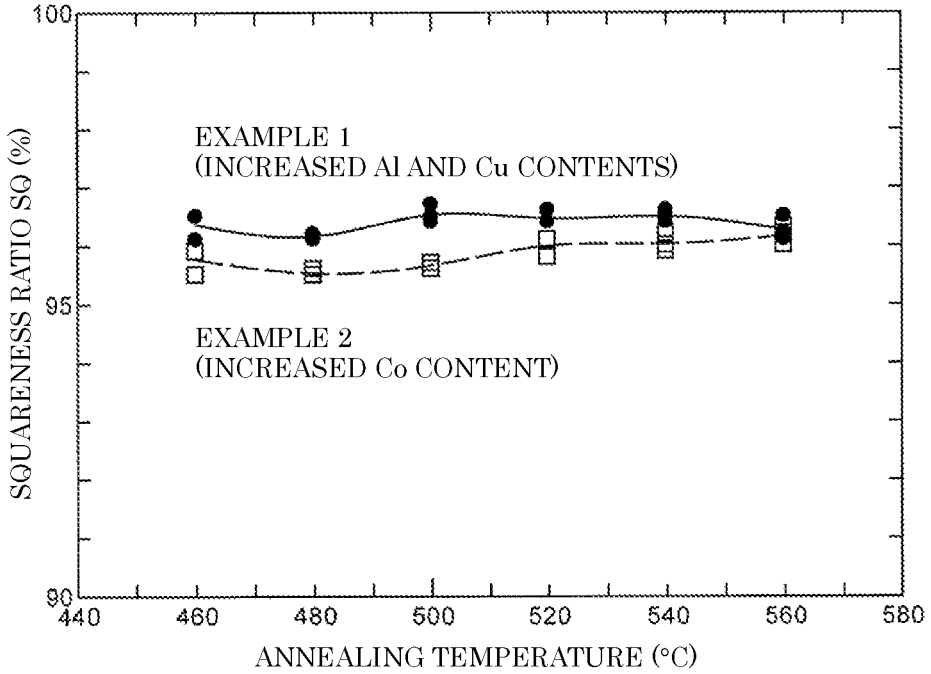
FIG. 3 is a graph which shows relationships between annealing temperature during the production in Examples 1 and 2 and measured values of squareness ratio.
Figure 4:
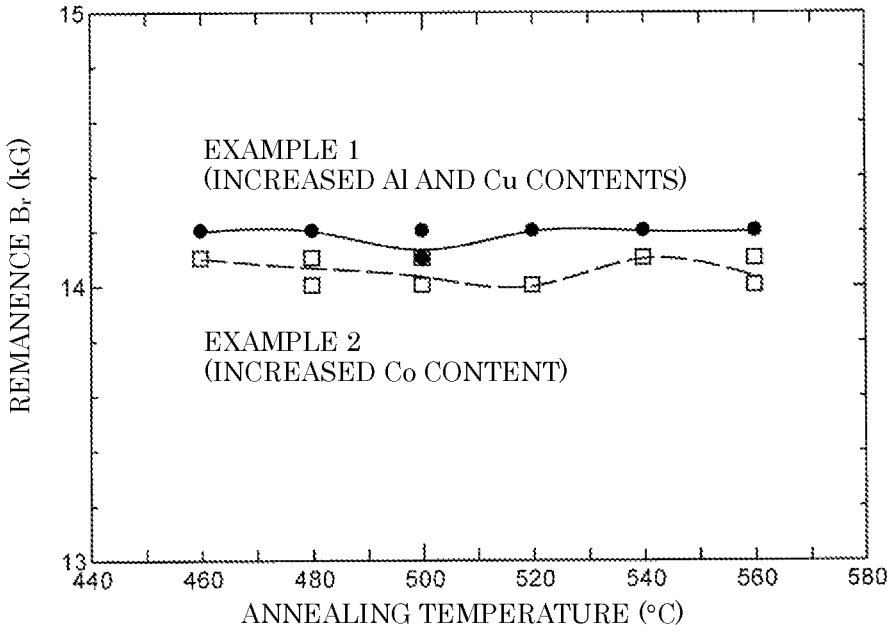
FIG. 4 is a graph which shows relationships between annealing temperature during the production in Examples 1 and 2 and measured values of remanence.

The RFeB-based sintered magnets of Examples 1 and 2, which had been produced using the different annealing temperatures, were each examined for coercivity $H_{cj}$, squareness ratio SQ, and remanence $B_r$. FIG. 2 shows the results of the examination for coercivity $H_{cj}$, FIG. 3 shows the results of the examination for squareness ratio SQ, and FIG. 4 shows the results of the examination for remanence $B_r$.

The values of coercivity $H_{cj}$ in Example 1 were in the range of 22.5-23.3 kOe and those in Example 2 were in the range of 22.3-23.2 kOe; sufficiently high values exceeding 20 kOe were obtained. This is thought to be because the inclusion of Zr in the alloys used as raw materials for the base materials had inhibited the occurrence of abnormal grain growth and because the grain boundary diffusion treatment had rendered the Tb present at a higher content in the surfaces of the crystal grains of the RFeB-based sintered magnet than in the centers of the crystal grains.

The values of coercivity $H_{cj}$ of the sintered magnets produced through the annealing experiment performed at the temperatures throughout that range were within the range of ±2% with respect to the medial value (22.9 kOe in Example 1 and 22.8 kOe in Example 2). The coercivity $H_{cj}$ thereof showed no tendency to decrease with rising or declining annealing temperature.

The values of squareness ratio in Example 1 were in the range of 96.1-96.7% (median value, 96.4%) and those in Examples 2 were in the range of 95.5-96.3% (median value, 95.9%); sufficiently high values exceeding 95% were obtained. The reasons for this are thought to be the same as those for the high coercivity $H_{cj}$. The values of squareness ratio SQ of the sintered magnets produced through the annealing experiment performed at the temperatures throughout that range were within the range of ±0.4% with respect to the median value. The squareness ratio SQ thereof showed no tendency to decrease with rising or declining annealing temperature.

As described above, in Examples 1 and 2, sufficiently large values of coercivity $H_{cj}$ and squareness ratio SQ were attained through the annealing performed at temperatures throughout the 100° C.-wide range of 460-560° C. In addition, the obtained values were substantially even regardless of the differences in annealing temperature. Because of this, even in cases when a large number of unannealed RFeB-based sintered magnets are simultaneously annealed, RFeB-based sintered magnets which are substantially even in quality can be obtained without being affected by temperature differences of several tens of degrees centigrade between the unannealed RFeB-based sintered magnets. Hence, the efficiency of producing RFeB-based sintered magnets can be heightened.

With respect to the remanence $B_r$ also, substantially even values were obtained in each of Examples 1 and 2 regardless of the differences in annealing temperature.

(3-2) Examples 3 and 4 (Presence or Absence of Ga)

Next, an RFeB-based sintered magnet (Example 3) was produced by producing a Ga-containing base material from alloy 3, as a raw material, having the composition (measured values) shown in Table 3 and subjecting the base material to a grain boundary diffusion treatment in the same manner as in Examples 1 and 2. Another RFeB-based sintered magnet (Example 4) was produced by producing a Ga-free base material from alloy 4, as a raw material, shown in Table 3 and subjecting the base material to a grain boundary diffusion treatment in the same manner as described above to thereby regulate the contents of the elements other than Ga to values close to those in Example 3. In each of Examples 3 and 4, one of the obtained RFeB-based sintered magnets was analyzed for composition, and the measured values are shown in Table 4.

TABLE 3

| Compositions of alloys as raw materials for base materials (unit: mass %) | | | | | | | | | | | |
|---|---|---|---|---|---|---|---|---|---|---|---|
| | Nd | Pr | Dy | Tb | Co | B | Al | Cu | Ga | Zr | Fe |
| Alloy 3 | 25.5 | 4.49 | 0 | 0 | 2.54 | 0.99 | 0.20 | 0.12 | 0.09 | 0.10 | remainder |
| | $R^L$: 29.99 | | $R^H$: 0 | | | | | | | | |
| Alloy 4 | 25.3 | 4.53 | 0 | 0 | 2.53 | 0.98 | 0.17 | 0.12 | 0 | 0.10 | remainder |
| | $R^L$: 29.83 | | $R^H$: 0 | | | | | | | | |

TABLE 4

| Compositions of RFeB-based sintered magnets obtained (unit: mass %) | | | | | | | | | | | |
|---|---|---|---|---|---|---|---|---|---|---|---|
| | Nd | Pr | Dy | Tb | Co | B | Al | Cu | Ga | Zr | Fe |
| Example 3 | 25.0 | 4.44 | 0.01 | 0.59 | 2.46 | 0.98 | 0.25 | 0.34 | 0.09 | 0.10 | remainder |
| | $R^L$: 29.44 | | $R^H$: 0.60 | | | | | | | | |
| Example 4 | 25.0 | 4.41 | 0.02 | 0.53 | 2.40 | 0.98 | 0.23 | 0.33 | 0.00 | 0.10 | remainder |
| | $R^L$: 29.41 | | $R^H$: 0.55 | | | | | | | | |

Figure 5:
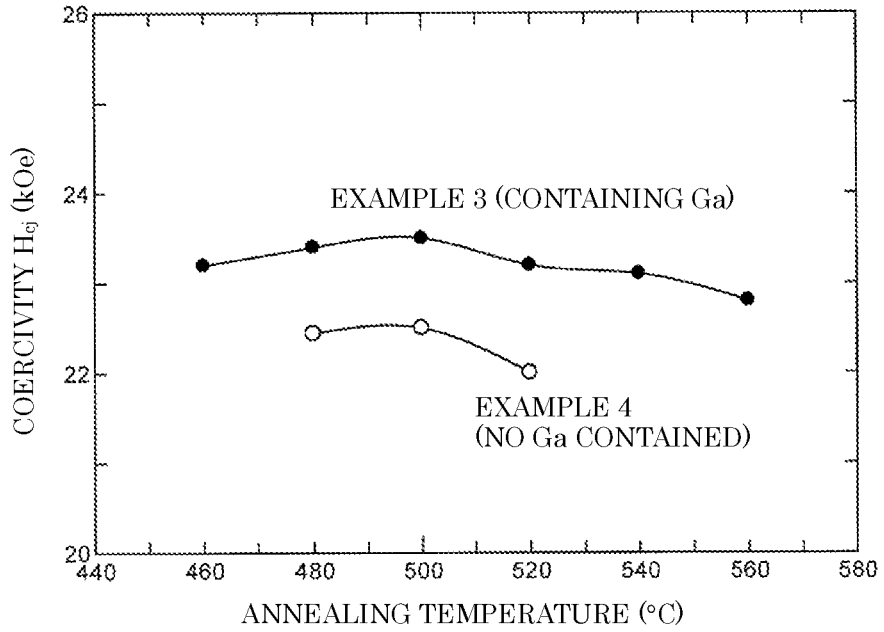
FIG. 5 is a graph which show relationships between annealing temperature during production in Examples 3 and 4 and measured values of coercivity.
Figure 6:
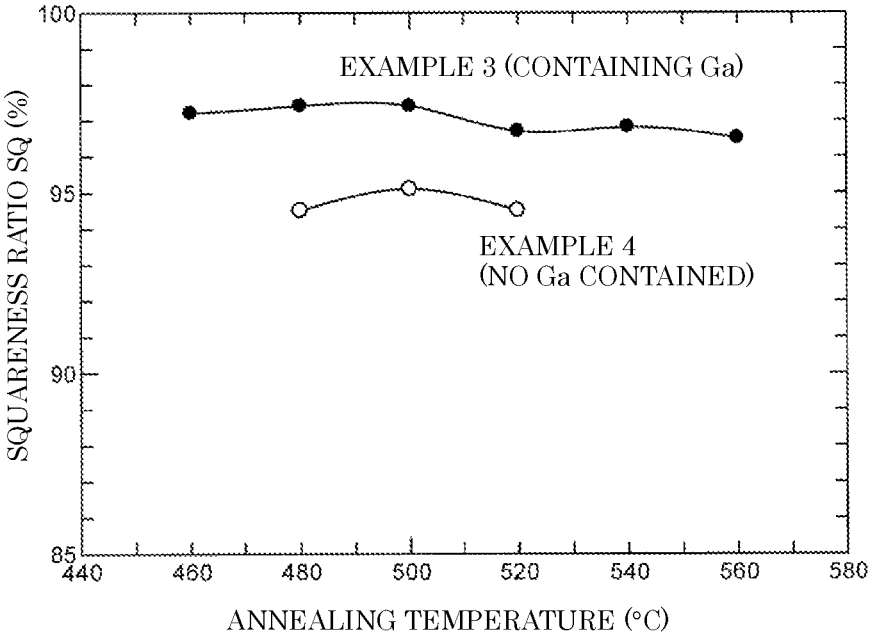
FIG. 6 is a graph which shows relationships between annealing temperature during the production in Examples 3 and 4 and measured values of squareness ratio.

The RFeB-based sintered magnets of Examples 3 and 4, which had been produced using the different annealing temperatures, were each examined for coercivity $H_{cJ}$ and squareness ratio SQ. FIG. 5 shows the results of the examination for coercivity $H_{cJ}$, and FIG. 6 shows the results of the examination for squareness ratio SQ. In Example 3, sufficiently high values of coercivity exceeding 20 kOe were obtained, and the values of coercivity of the sintered magnets produced through the annealing experiment performed at the temperatures throughout that range were within the range of ±2% with respect to the median value (23.28 kOe), as in Examples 1 and 2. In Example 3, the values of squareness ratio were in the range of 96.5-97.4% (median value, 97.0%); sufficiently high values exceeding 95% were obtained. The values of coercivity and squareness ratio corresponding to each temperature were higher in Example 3 than in Example 4. It was thus ascertained that the addition of Ga in the RFeB-based sintered magnet according to the present invention heightens the values of coercivity and squareness ratio.

Figure 7:
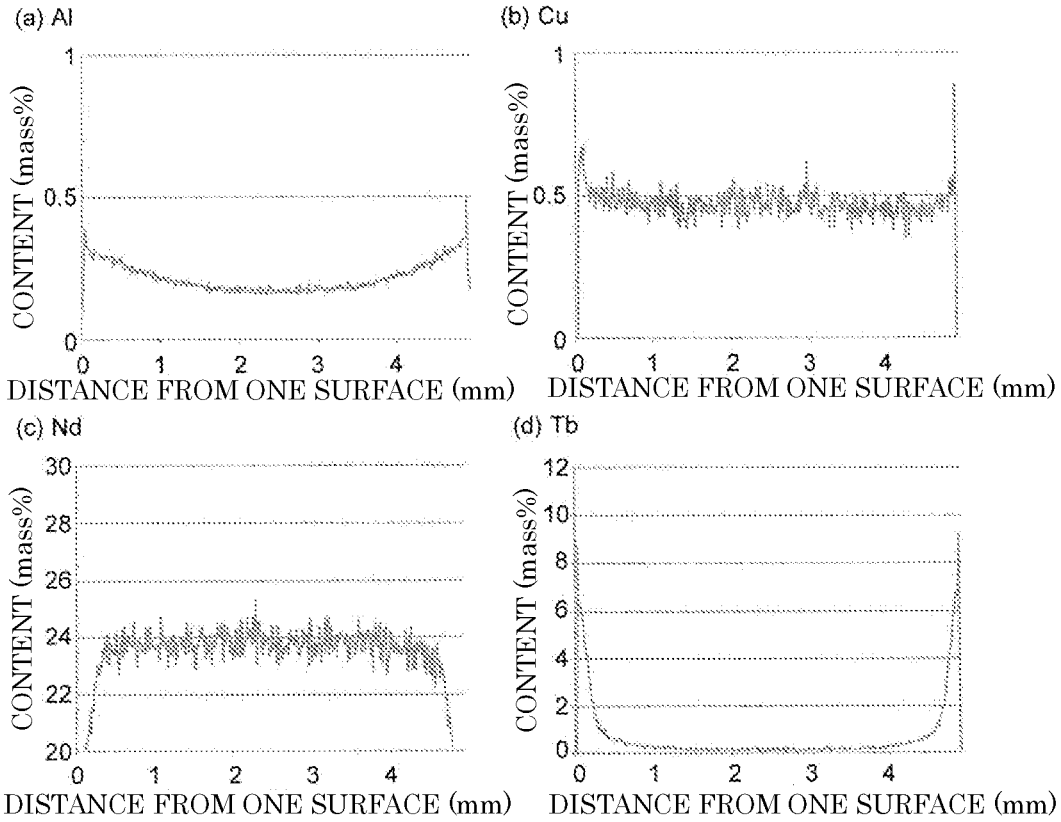
FIG. 7 includes graphs which show the results of an examination for determining a distribution of the content of each of: (a) Al; (b) Cu; (c) Nd; and (d) Tb along the depth direction from the surface in a sample of Example 3.

Next, a sample of Example 3 was examined for the distribution of the content of each of Al, Cu, Nd and Tb along the depth direction from the surface, and the results thereof are explained. The results of the examination are shown in FIG. 7. The graphs (a) to (d) in FIG. 7 each show the distribution of contents at positions along the direction of depth from one surface of the plate-shaped sample, the position of the surface being taken as 0. Since the thickness of the sample was 4.8 mm, the position "2.4 mm" in each graph is the depth-direction center. The contents of Al, Cu and Tb gradually decreased from each surface of the sample toward the inside, whereas the content of Nd did not show such tendency. This is due to the fact that Al, Cu and Tb had been introduced into the sample by the grain boundary diffusion treatment.

(3-3) Examples 3 and 5 to 7, Comparative Example 1 (Differences in Co Concentration)

Next, samples of Examples 5 to 7 and Comparative Example 1, which were RFeB-based sintered magnets differing in Co concentration, are explained together with the samples of Example 3 given above. These samples of Examples 5 to 7 and Comparative Example 1 were produced in the same manner as in Example 3, except for differences in the concentrations of Co, etc. in the base material. Measured values of the composition of each of the raw-material alloys used for the samples of Examples 5 to 7 and Comparative Example 1 are shown in Table 5, and measured values of composition obtained by analyzing one of the RFeB-based sintered magnets obtained in each of the Examples and Comparative Example are shown in Table 6. Alloys 5 to 7 were raw materials for the samples of Examples 5 to 7, respectively, and alloy A was a raw material for the samples of Comparative Example 1.

TABLE 5

| Compositions of alloys as raw materials for base materials (unit: mass %) | | | | | | | | | | | |
|---|---|---|---|---|---|---|---|---|---|---|---|
| | Nd | Pr | Dy | Tb | Co | B | Al | Cu | Ga | Zr | Fe |
| Alloy 5 | 25.5 | 4.49 | 0 | 0 | 0.93 | 0.99 | 0.17 | 0.12 | 0.09 | 0.10 | remainder |
| | $R^L$: 29.99 | | $R^H$: 0 | | | | | | | | |
| Alloy 6 | 25.5 | 4.55 | 0 | 0 | 1.42 | 0.99 | 0.19 | 0.12 | 0.10 | 0.10 | remainder |
| | $R^L$: 30.05 | | $R^H$: 0 | | | | | | | | |
| Alloy 7 | 25.5 | 4.55 | 0 | 0 | 6.00 | 0.99 | 0.19 | 0.12 | 0.10 | 0.10 | remainder |
| | $R^L$: 30.05 | | $R^H$: 0 | | | | | | | | |
| Alloy A | 25.4 | 4.54 | 0 | 0 | 10.10 | 0.99 | 0.19 | 0.13 | 0.10 | 0.10 | remainder |
| | $R^L$: 29.94 | | $R^H$: 0 | | | | | | | | |

TABLE 6

| Compositions of RFeB-based sintered magnets obtained (unit: mass %) | | | | | | | | | | | |
|---|---|---|---|---|---|---|---|---|---|---|---|
| | Nd | Pr | Dy | Tb | Co | B | Al | Cu | Ga | Zr | Fe |
| Example 5 | 25.1 | 4.39 | 0.01 | 0.45 | 0.93 | 0.98 | 0.22 | 0.30 | 0.09 | 0.09 | remainder |
| | $R^L$: 29.49 | | $R^H$: 0.46 | | | | | | | | |
| Example 6 | 24.7 | 4.40 | 0.01 | 0.37 | 1.42 | 1.01 | 0.24 | 0.28 | 0.10 | 0.10 | remainder |
| | $R^L$: 29.10 | | $R^H$: 0.38 | | | | | | | | |
| Example 7 | 24.7 | 4.41 | 0.01 | 0.46 | 5.45 | 1.02 | 0.24 | 0.29 | 0.10 | 0.10 | remainder |
| | $R^L$: 29.11 | | $R^H$: 0.47 | | | | | | | | |
| Comparative Example 1 | 24.7 | 4.43 | 0.01 | 0.46 | 9.18 | 1.02 | 0.24 | 0.30 | 0.10 | 0.10 | remainder |
| | $R^L$: 29.13 | | $R^H$: 0.47 | | | | | | | | |

Figure 8:
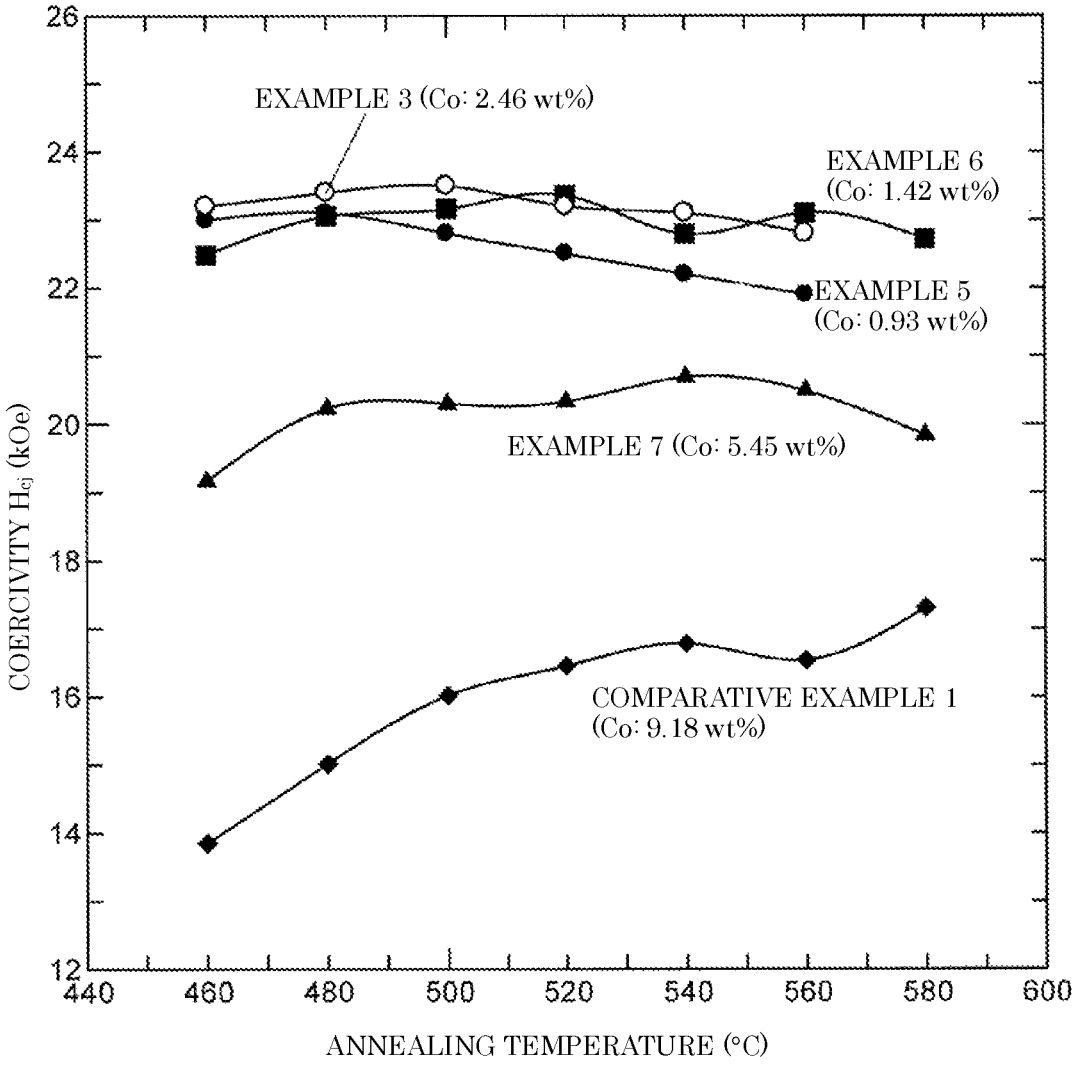
FIG. 8 is a graph which shows relationships between annealing temperature in producing RFeB-based sintered magnets according to the present invention in Examples 3 and 5 to 7 and Comparative Example 1 and measured values of coercivity.

The RFeB-based sintered magnets of Examples 3 and 5 to 7, which had been produced using the different annealing temperatures, were examined for coercivity $H_{cj}$, and the results thereof are shown in FIG. 8. The samples of Examples 3, 5, and 6 (Co contents: 2.46, 0.93, and 1.42), which had been produced through the annealing performed at the temperatures throughout the range of 460-560° C. (in Example 6, 460-580° C.), had sufficiently high values of coercivity $H_{cj}$ exceeding 20 kOe. In Example 7, the coercivitys $H_{cj}$ of only the samples which had undergone the annealing performed at the lowest (460° C.) and the highest (580° C.) temperatures, respectively, were slightly lower than 20 kOe, and those of the other samples exceeded 20 kOe. With respect to deviation from the median value (23.2 kOe in Example 3; 22.5 kOe in Example 5; 22.9 kOe in Example 6; and 19.9 kOe in Example 7) for the samples produced through the annealing performed at the temperatures throughout the range, the deviation in Example 3 was ±1.5%, that in Example 5 was ±2.7%, that in Example 6 was ±1.9%, and that in Example 7 was ±3,8%. In each Example, the deviation was less than ±5%. In contrast, in Comparative Example 1, the values of coercivity $H_{cj}$ of the samples produced through the annealing performed at the temperatures throughout the range were as low as 13.9-17.3 kOe, and the deviation from the median value (15.6 kOe) was as large as ±11.1%, the absolute value thereof being not less than 5%.

As shown above, the RFeB-based sintered magnets of Examples 3 and 5 to 7 had changed less in coercivity with changing annealing temperature than that of Comparative Example 1 and, hence, had had a wide annealing temperature range. Of the RFeB-based sintered magnets of those Examples, the RFeB-based sintered magnets of Examples 3 and 6, in particular, which had Co contents in the range of 1.4-2.5% by mass, had higher coercivities and had changed less in coercivity with changing annealing temperature, than Examples 5 and 7. In this respect, the RFeB-based sintered magnets of Examples 3 and 6 were superior to those of Examples 5 and 7.

The concentration of Co affects the Curie temperature of the RFeB-based sintered magnet. For example, the sintered magnet of Example 5 (Co content, 0.93% by mass) had a Curie temperature of 317° C., whereas that of Example 3 (Co content, 2.46% by mass) had a Curie temperature of 335° C.

(3-3) Compositions of Grain Boundaries in Examples 3, 6, and 7 and Comparative Example 1

Next, the RFeB-based sintered magnets of Examples 3, 6, and 7 and Comparative Example 1 were each examined for the composition of grain boundaries, and the results thereof are shown. In this examination, a cross-section of each RFeB-based sintered magnet was examined with an electron microscope to obtain an image thereof, and 11-15 portions of the grain boundaries in the image were specified. The composition at each portion was determined by EPMA. The results thereof are shown in Table 7 (Example 3), Table 8 (Example 6), Table 9 (Example 7), and Table 10 (Comparative Example 1). In each table, the contents of Nd, Pr, Tb (these three elements belonging to the rare earth elements R), Fe, Co, Al, Cu, and Ga are indicated in atomic percent. Incidentally, the RFeB-based sintered magnets of the Examples and Comparative Example each contained slight amounts of elements other than these eight elements and, hence, the total of the contents of the eight elements is not always 100 (at. %).

TABLE 7

| Compositions in portions of grain boundaries in Example 3 (Co = 2.46 mass %) | | | | | | | | | |
|---|---|---|---|---|---|---|---|---|---|
| Test portion | Contents of elements (at. %) | | | | | | | | |
| | R | | | | | | | | |
| No. | Nd | Pr | Tb | Fe | Co | Al | Cu | Ga | Remarks |
| 1 | 48.0 | 14.1 | 0.8 | 13.3 | 14.9 | 0.7 | 8.0 | 0.4 | |
| 2 | 51.8 | 14.1 | 0.8 | 11.6 | 14.8 | 0.2 | 6.7 | 0.1 | |
| 3 | 55.0 | 14.3 | 0.6 | 7.1 | 14.8 | 0.7 | 7.3 | 0.1 | |
| 4 | 53.2 | 13.8 | 0.8 | 10.6 | 14.6 | 0.6 | 6.4 | 0.1 | |
| 5 | 49.4 | 13.8 | 0.5 | 14.9 | 13.3 | 0.7 | 7.2 | 0.2 | |
| 6 | 49.4 | 12.8 | 0.7 | 16.1 | 12.8 | 0.5 | 7.7 | 0.0 | |
| 7 | 10.1 | 1.7 | 0.0 | 85.2 | 2.3 | 0.5 | 0.0 | 0.2 | main phase |
| 8 | 11.2 | 1.8 | 0.0 | 83.8 | 2.5 | 0.7 | 0.0 | 0.1 | main phase |
| 9 | 75.3 | 12.7 | 0.0 | 10.3 | 1.2 | 0.4 | 0.0 | 0.0 | O,C-rich |
| 10 | 73.3 | 13.4 | 0.0 | 10.6 | 1.6 | 1.1 | 0.0 | 0.0 | O,C-rich |
| 11 | 67.6 | 12.8 | 0.0 | 17.4 | 1.5 | 0.6 | 0.0 | 0.1 | O,C-rich |

TABLE 8

| Compositions in portions of grain boundaries in Example 6 (Co = 1.42 mass %) | | | | | | | | | |
|---|---|---|---|---|---|---|---|---|---|
| Test portion | Contents of elements (at. %) | | | | | | | | |
| | R | | | | | | | | |
| No. | Nd | Pr | Tb | Fe | Co | Al | Cu | Ga | Remarks |
| 1 | 47.4 | 13.8 | 0.6 | 18.2 | 13.4 | 0.3 | 6.2 | 0.2 | |
| 2 | 52.7 | 14.7 | 0.4 | 12.9 | 11.9 | 0.5 | 6.8 | 0.2 | |
| 3 | 45.4 | 14.4 | 0.6 | 15.3 | 17.5 | 1.1 | 5.7 | 0.1 | |
| 4 | 53.9 | 13.8 | 0.3 | 9.1 | 14.8 | 0.3 | 7.8 | 0.0 | |
| 5 | 50.0 | 15.8 | 0.2 | 7.9 | 16.8 | 0.3 | 8.5 | 0.5 | |
| 6 | 55.1 | 13.9 | 0.6 | 6.5 | 16.4 | 0.2 | 7.1 | 0.3 | |
| 7 | 51.7 | 14.8 | 0.5 | 8.0 | 17.7 | 0.1 | 7.1 | 0.1 | |
| 8 | 10.8 | 1.7 | 0.1 | 84.8 | 2.0 | 0.5 | 0.0 | 0.0 | main phase |
| 9 | 10.1 | 1.9 | 0.0 | 85.5 | 2.1 | 0.4 | 0.0 | 0.0 | main phase |

TABLE 8-continued

Compositions in portions of grain boundaries in Example 6 (Co = 1.42 mass %)

| Test portion No. | Contents of elements (at. %) R Nd | Pr | Tb | Fe | Co | Al | Cu | Ga | Remarks |
|---|---|---|---|---|---|---|---|---|---|
| 10 | 71.1 | 13.3 | 0.0 | 13.1 | 1.4 | 0.7 | 0.0 | 0.5 | O,C-rich |
| 11 | 69.8 | 13.3 | 0.2 | 14.9 | 1.3 | 0.3 | 0.0 | 0.1 | O,C-rich |

TABLE 9

Compositions in portions of grain boundaries in Example 7 (Co = 5.45 mass %)

| Test portion No. | Contents of elements (at. %) R Nd | Pr | Tb | Fe | Co | Al | Cu | Ga | Remarks |
|---|---|---|---|---|---|---|---|---|---|
| 1 | 48.6 | 13.5 | 0.8 | 10.7 | 22.6 | 0.4 | 3.1 | 0.2 | |
| 2 | 48.0 | 14.3 | 0.8 | 11.5 | 22.2 | 0.0 | 3.2 | 0.0 | |
| 3 | 48.4 | 13.7 | 0.8 | 10.8 | 22.9 | 0.4 | 3.0 | 0.0 | |
| 4 | 53.1 | 14.6 | 0.7 | 5.4 | 22.8 | 0.0 | 3.4 | 0.0 | |
| 5 | 54.4 | 14.2 | 0.8 | 4.8 | 23.3 | 0.1 | 2.3 | 0.1 | |
| 6 | 51.2 | 14.7 | 0.8 | 7.7 | 22.5 | 0.2 | 2.8 | 0.0 | |
| 7 | 52.0 | 14.5 | 0.9 | 6.3 | 23.0 | 0.2 | 3.1 | 0.0 | |
| 8 | 52.6 | 13.7 | 0.9 | 10.1 | 17.9 | 0.3 | 3.9 | 0.5 | |
| 9 | 9.8 | 2.0 | 0.0 | 81.1 | 6.7 | 0.3 | 0.0 | 0.0 | main phase |
| 10 | 10.0 | 1.9 | 0.0 | 80.9 | 6.9 | 0.4 | 0.0 | 0.0 | main phase |
| 11 | 10.5 | 1.9 | 0.0 | 80.6 | 6.5 | 0.4 | 0.0 | 0.1 | main phase |
| 12 | 9.7 | 1.5 | 0.0 | 81.9 | 6.5 | 0.4 | 0.0 | 0.0 | main phase |
| 13 | 35.3 | 7.2 | 3.8 | 48.1 | 4.9 | 0.5 | 0.1 | 0.0 | O,C-rich |
| 14 | 63.0 | 12.2 | 0.0 | 22.1 | 2.4 | 0.2 | 0.0 | 0.1 | O,C-rich |
| 15 | 52.2 | 14.4 | 0.6 | 11.2 | 18.2 | 0.1 | 2.6 | 0.7 | O,C-rich |

TABLE 10

Compositions in portions of grain boundaries in Comparative Example 1 (Co = 9.18 mass %)

| Test portion No. | Contents of elements (at. %) R Nd | Pr | Tb | Fe | Co | Al | Cu | Ga | Remarks |
|---|---|---|---|---|---|---|---|---|---|
| 1 | 29.9 | 9.2 | 0.5 | 26.4 | 19.5 | 0.5 | 12.7 | 1.4 | |
| 2 | 40.3 | 10.9 | 0.4 | 11.1 | 21.2 | 0.5 | 14.1 | 1.5 | |
| 3 | 45.6 | 11.9 | 0.9 | 11.8 | 28.2 | 0.2 | 1.4 | 0.0 | |
| 4 | 49.2 | 14.3 | 1.3 | 4.8 | 28.5 | 0.5 | 1.0 | 0.4 | |
| 5 | 50.6 | 14.0 | 0.9 | 4.3 | 28.7 | 0.1 | 1.4 | 0.0 | |
| 6 | 47.6 | 14.8 | 0.7 | 4.4 | 30.6 | 0.1 | 1.5 | 0.3 | |
| 7 | 10.2 | 1.6 | 0.0 | 76.7 | 11.0 | 0.5 | 0.0 | 0.0 | main phase |
| 8 | 10.8 | 1.8 | 0.0 | 75.8 | 10.8 | 0.7 | 0.0 | 0.0 | main phase |
| 9 | 10.1 | 1.6 | 0.0 | 77.3 | 10.4 | 0.5 | 0.0 | 0.0 | main phase |
| 10 | 58.6 | 11.6 | 0.3 | 24.6 | 4.6 | 0.3 | 0.0 | 0.0 | O,C-rich |
| 11 | 71.3 | 14.1 | 0.3 | 11.2 | 2.9 | 0.1 | 0.0 | 0.1 | O,C-rich |
| 12 | 70.2 | 14.0 | 0.3 | 10.9 | 3.7 | 0.3 | 0.5 | 0.0 | O,C-rich |
| 13 | 71.7 | 14.6 | 0.0 | 8.3 | 4.2 | 0.0 | 0.9 | 0.2 | O,C-rich |

Each test portion indicated by "main phase" in the remarks column in Tables 7 to 10 had a composition close to that of the main phase ($R_2Fe_{14}B$) of the RFeB-based magnet. Each test portion indicated by "0,C-rich" in the column had a higher 0 or C content than other test portions and is thought to have contained an oxide or carbide formed therein, although this is not shown in the table. These test portions indicated by "main phase" and "O,C-rich" each had a lower Co content than other test portions.

The results of the examination of the test portions other than those indicated by "main phase" and "O,C-rich", which had higher Co contents, are discussed below. With respect to each of these test portions, the eight elements shown in Tables 7 to 10 were divided into three groups: Nd, Pr and Tb (rare earth elements R); Fe and Co (iron-group elements); and Al, Cu and Ga. The total content was determined for each group. Furthermore, a content ratio between the group including Nd, Pr and Tb and the group including Fe and Co was determined. The results thereof are shown in Table 11 (Example 3), Table 12 (Example 6), Table 13 (Example 7), and Table 14 (Comparative Example 1).

TABLE 11

Compositions in portions of grain boundaries in Example 3 (Co = 2.46 mass %) (2)

| Test portion No. | Contents (at. %) Nd + Pr + Tb | Fe + Co | Al + Cu + Ga | (Nd + Pr + Tb)/(Fe + Co) |
|---|---|---|---|---|
| 1 | 62.8 | 28.2 | 9.0 | 2.229 |
| 2 | 66.7 | 26.4 | 6.9 | 2.523 |
| 3 | 70.0 | 21.9 | 8.1 | 3.191 |
| 4 | 67.8 | 25.2 | 7.0 | 2.690 |
| 5 | 63.8 | 28.2 | 8.0 | 2.258 |
| 6 | 62.9 | 28.9 | 8.2 | 2.175 |

TABLE 12

Compositions in portions of grain boundaries in Example 6 (Co = 1.42 mass %) (2)

| Test portion No. | Contents (at. %) Nd + Pr + Tb | Fe + Co | Al + Cu + Ga | (Nd + Pr + Tb)/(Fe + Co) |
|---|---|---|---|---|
| 1 | 61.7 | 31.6 | 6.7 | 1.951 |
| 2 | 67.8 | 24.7 | 7.5 | 2.741 |
| 3 | 60.3 | 32.8 | 6.9 | 1.838 |
| 4 | 68.0 | 24.0 | 8.1 | 2.836 |
| 5 | 66.1 | 24.7 | 9.3 | 2.678 |
| 6 | 69.6 | 22.8 | 7.6 | 3.048 |
| 7 | 67.1 | 25.7 | 7.3 | 2.612 |

TABLE 13

Compositions in portions of grain boundaries in Example 7 (Co = 5.45 mass %) (2)

| Test portion No. | Contents (at. %) Nd + Pr + Tb | Fe + Co | Al + Cu + Ga | (Nd + Pr + Tb)/(Fe + Co) |
|---|---|---|---|---|
| 1 | 63.0 | 33.3 | 3.8 | 1.891 |
| 2 | 63.1 | 33.7 | 3.2 | 1.875 |
| 3 | 63.0 | 33.7 | 3.4 | 1.871 |
| 4 | 68.4 | 28.2 | 3.4 | 2.424 |
| 5 | 69.4 | 28.1 | 2.5 | 2.469 |
| 6 | 66.8 | 30.3 | 3.0 | 2.206 |
| 7 | 67.4 | 29.3 | 3.3 | 2.301 |
| 8 | 67.2 | 28.1 | 4.7 | 2.395 |

TABLE 14

| Compositions in portions of grain boundaries in Comparative Example 1 (Co = 9.18 mass %) (2) | | | | |
|---|---|---|---|---|
| Test portion | Contents (at. %) | | | (Nd + Pr + Tb)/ |
| No. | Nd + Pr + Tb | Fe + Co | Al + Cu + Ga | (Fe + Co) |
| 1 | 39.5 | 45.9 | 14.6 | 0.861 |
| 2 | 51.6 | 32.3 | 16.1 | 1.595 |
| 3 | 58.4 | 40.0 | 1.6 | 1.459 |
| 4 | 64.8 | 33.3 | 1.9 | 1.942 |
| 5 | 65.5 | 33.0 | 1.5 | 1.985 |
| 6 | 63.1 | 35.0 | 1.9 | 1.805 |

The results in Tables 11 to 14 show the following. In each of the RFeB-based sintered magnets of Examples 3, 6, and 7, the total content of the elements in each of the three groups is as follows: the total content of the group including Nd, Pr and Tb was in the range of 60-70 at. %; that of the group including Fe and Co was in the range of 20-35 at. %; and that of the group including Al, Cu and Ga was in the range of 6-10 at. %. In contrast, in the RFeB-based sintered magnet of Comparative Example 1, the total content of the elements in at least one of the three groups was not in the corresponding range shown above.

Furthermore, in Examples 3 and 6, the content ratio between the rare earth elements R and the iron-group elements in each of a plurality of test portions (three of the six portions in Example 3; five of the seven portions in Example 6) was larger than 2.5 but less than 3.2. In contrast, in Example 7 and Comparative Example 1, there was no portion where the content ratio was within that range. The test portions (grain boundaries) where the content ratio between the rare earth elements R and the iron-group elements is such a value around 3, i.e., larger than 2.5 but less than 3.2, are thought to contain an $R_3$(Co,Fe) phase. A comparison between these results and the relationships between annealing temperature during production and measured values of coercivity shown in FIG. 8 shows the following. The RFeB-based sintered magnets of Examples 3 and 6, in which the content ratios were within that range, produced through the annealing performed at any of the temperatures had higher coercivitys and had changed less in coercivity with changing annealing temperature to have attained a wider annealing temperature range, than the RFeB-based sintered magnets of Example 7 and Comparative Example 1, in which the content ratios were outside that range. Namely, the presence of an $R_3$(Co,Fe) phase in the grain boundaries in an RFeB-based sintered magnet contributes to heightening the coercivity and widening the annealing temperature range.

(3-4) Example 3 and Comparative Examples 2 and 3 (Difference in Composition Among Alloys for Use in Grain Boundary Diffusion Treatment)

Next, an explanation is given on Comparative Example 2, in which a base material produced from the same batch as in Example 3 was subjected to a grain boundary diffusion treatment using a TbCu alloy containing no Al, and on Comparative Example 3, in which the base material was subjected to a grain boundary diffusion treatment using a TbAl alloy containing no Cu. The TbCu alloy used in Comparative Example 2 included 85.4% by mass of Tb and 14.6% by mass of Cu, while the TbAl alloy used in Comparative Example 3 included 95.4% by mass of Tb and 4.6% by mass of Al. Two adhesion materials respectively containing these two alloys and one adhesion material containing the TbAlCu alloy were each applied to the base material so that the Tb was contained in the same amount in the adhesion materials (Example 3 corresponded to the experiment regarding the TbAlCu alloy). The amounts of the adhesion materials actually applied, in terms of alloy amount per one surface (17 mm×17 mm) of the plate-shaped base material, were 73 g in Example 3 (TbAlCu alloy), 64 g in Comparative Example 2 (TbCu alloy), and 57 g in Comparative Example 3 (TbAl alloy). The coated base materials were heated under the same conditions as in Example 1, etc., thereby performing a grain boundary diffusion treatment. One of the produced RFeB-based sintered magnet samples of each of Comparative Examples 2 and 3 was analyzed for composition, and the measured values are shown in Table 15.

TABLE 15

| Compositions of RFeB-based sintered magnets obtained (unit: mass %) | | | | | | | | | | | |
|---|---|---|---|---|---|---|---|---|---|---|---|
| | Nd | Pr | Dy | Tb | Co | B | Al | Cu | Ga | Zr | Fe |
| Comparative Example 2 | 25.1 | 4.35 | 0.01 | 0.44 | 2.48 | 0.98 | 0.20 | 0.29 | 0.09 | 0.10 | remainder |
| | $R^L$: 29.45 | | $R^H$: 0.45 | | | | | | | | |
| Comparative Example 3 | 25.1 | 4.40 | 0.01 | 0.34 | 2.49 | 0.98 | 0.23 | 0.12 | 0.09 | 0.09 | remainder |
| | $R^L$: 29.50 | | $R^H$: 0.35 | | | | | | | | |

In cases when attention is directed to the contents of Cu and Al, the contents of Cu alone and the contents of Al alone in Comparative Examples 2 and 3 were within the respective ranges (0.1-1.0% by mass each) according to the present invention. However, the total content of Cu and Al in Comparative Example 2 was 0.49% by mass and that in Comparative Example 3 was 0.35% by mass, these content values being outside the range (higher than 0.5% by mass) according to the present invention. Consequently, the samples of Comparative Examples 2 and 3 are not RFeB-based sintered magnets according to the present invention.

In Example 3 and Comparative Examples 2 and 3, base materials produced from the same batch were subjected to a grain boundary diffusion treatment using adhesion materials containing Tb in the same amount. Despite this, the RFeB-based sintered magnets obtained in Example 3 had a higher Tb content than the RFeB-based sintered magnets obtained in Comparative Examples 2 and 3. Namely, the use of the TbCuAl alloy, which included both Cu and Al, in the grain boundary diffusion treatment, was more effective in diffusing the Tb throughout the grain boundaries of the base material than the use of the TbCu or TbAl alloy, which included either Cu or Al only.

Figure 9:
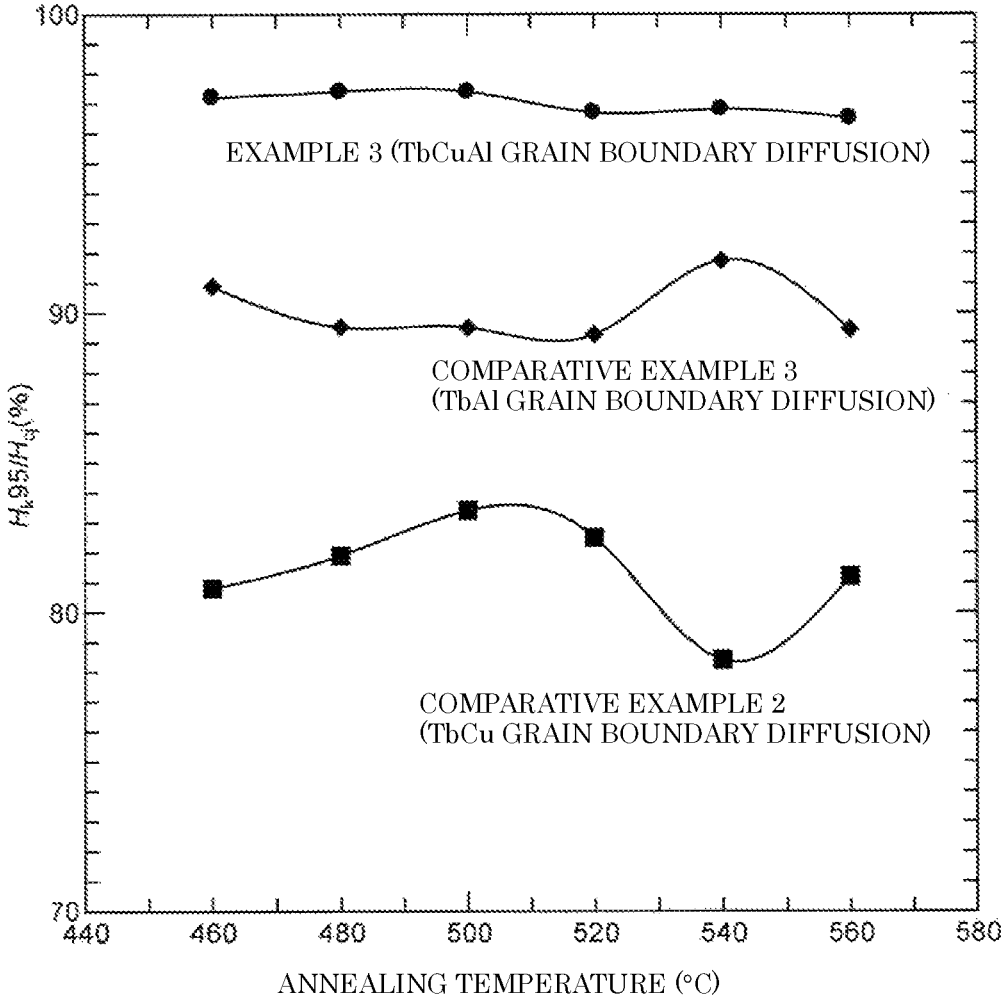
FIG. 9 is a graph which shows relationships between annealing temperature during production in Example 3 and Comparative Examples 2 and 3 and measured values of $H_k9/H_{cj}$.

The RFeB-based sintered magnets produced in each of Example 3 and Comparative Examples 2 and 3 through the annealing performed at the different temperatures were each examined to determine the value of $H_k95/H_{cj}$ defined below. $H_k95/H_{cj}$ is defined as a ratio between the opposing magnetic field (expressed by "$H_k95$") at the time when the magnetization in a demagnetization curve becomes 95% of the remanence $B_r$ and the coercivity $H_{cj}$. Like the squareness ratio SQ, $H_k95/H_{cj}$ is an index to the squareness of the demagnetization curve, and is equal to the SQ defined hereinabove except that the "90%" in the expression "opposing magnetic field at the time when the magnetization . . . becomes 90% of the remanence $B_r$" is replaced by "95%". $H_k95/H_{cj}$ varies more widely depending on the degree of squareness than SQ. The results of the determination of $H_k95/H_{cj}$ are shown in FIG. 9. The results show that the sintered magnets of Example 3 produced through the annealing performed at the temperatures throughout the range shown hereinabove had higher values of $H_k95/H_{cj}$ and better squareness than those of Comparative Examples 2 and 3.

The present invention is not limited to the embodiments shown above and can be variously modified as a matter of course. For example, although the embodiments shown above contained Nd and Pr as $R^L$, the RFeB-based sintered magnet may contain either Nd or Pr or may contain La and/or Ce in addition to or in place of Nd and/or Pr. Although the embodiments shown above contained Tb and Dy as $R^H$, the RFeB-based sintered magnet may contain either Tb or Dy.

The present application is based on Japanese patent application No. 2018-129932 filed on Jul. 9, 2018, and Japanese patent application No. 2019-009098 filed on Jan. 23, 2019, and the contents of which are incorporated herein by reference.

DESCRIPTION OF REFERENCE NUMERALS AND SIGNS

10 . . . RFeB-based sintered magnet
11 . . . Base material
111 . . . Raw-material powder
112 . . . Compression-molded object
113 . . . Mold
12 . . . Adhesion material
121 . . . Powder for grain boundary diffusion treatment
122 . . . Silicone grease
13 . . . Unannealed RFeB-based sintered magnet

What is claimed is:

1. An RFeB-based sintered magnet having a composition comprising:

24-31% by mass of at least one element selected from the group consisting of Nd, Pr, La and Ce;

1-6.5% by mass of at least one element selected from the group consisting of Dy and Tb;

8-1.4% by mass of B;

03-0.2% by mass of at least one element selected from the group consisting of Zr, Ti, Hf and Nb;

8-5.5% by mass of Co;

1-1.0% by mass of Cu; and 0.1-1.0% by mass of Al;

with a remainder being Fe and unavoidable impurities, wherein the composition has a total content of Cu and Al being higher than 0.5% by mass, and wherein the RFeB-based sintered magnet has a distribution in which the content of Cu gradually decreases from a surface of the RFeB-based sintered magnet toward an inner part thereof.

2. The RFeB-based sintered magnet according to claim 1, having a distribution in which the content of Al gradually decreases from a surface of the RFeB-based sintered magnet toward an inner part thereof.

3. The RFeB-based sintered magnet according to claim 1, wherein the content of Co is 1.4-2.5% by mass.

4. The RFeB-based sintered magnet according to claim 1, containing an $R_3(Co,Fe)$ phase at the grain boundaries thereof.

5. The RFeB-based sintered magnet according to claim 1, wherein the content of the at least one element selected from the group consisting of Dy and Tb is higher in a surface of each crystal grain than in the center of the crystal grain.

6. The RFeB-based sintered magnet according to claim 1, wherein the composition further comprises 0.05-1.0% by mass of Ga.

7. The RFeB-based sintered magnet according to claim 1, wherein the composition has a total content of all the rare earth elements of 32% by mass or less, and the RFeB-based sintered magnet has a coercivity of 20 kOe or higher and a squareness ratio of 90% or higher.

* * * * *